United States Patent [19]

Lutz

[11] Patent Number: 4,865,487

[45] Date of Patent: Sep. 12, 1989

[54] SCREED FOR ASPHALT PAVER

[75] Inventor: David L. Lutz, Loomis, Calif.

[73] Assignee: Kenco Engineering, Inc., Roseville, Calif.

[21] Appl. No.: 207,207

[22] Filed: Jun. 16, 1988

[51] Int. Cl.[4] ..... E01C 19/22

[52] U.S. Cl. ..... 404/118; 404/119

[58] Field of Search ..... 404/118, 119

[56] References Cited

U.S. PATENT DOCUMENTS

| | | | |
|---|---|---|---|
| 2,914,994 | 3/1957 | Pollitz | 404/118 |
| 3,673,930 | 7/1972 | Birtchet | 94/45 R |
| 3,702,578 | 11/1972 | Davin | 404/118 |
| 4,688,965 | 8/1987 | Smith | 404/118 |

OTHER PUBLICATIONS

Barber-Green Specifications Manual, p. 6842 dated 10-67, Model SA-35.

*Primary Examiner*—Stephen J. Novosad
*Assistant Examiner*—Gay Ann Spahn
*Attorney, Agent, or Firm*—Jack M. Wiseman

[57] ABSTRACT

A screed for an asphalt paver in which the bottom plate thereof is made of steel in the Brinell hardness range of 450-500 to engage road surfacing material. Stainless steel threaded studs are welded to the upper surface of the bottom plate for attachment of the screed to the asphalt paver.

10 Claims, 2 Drawing Sheets

Fig. 1
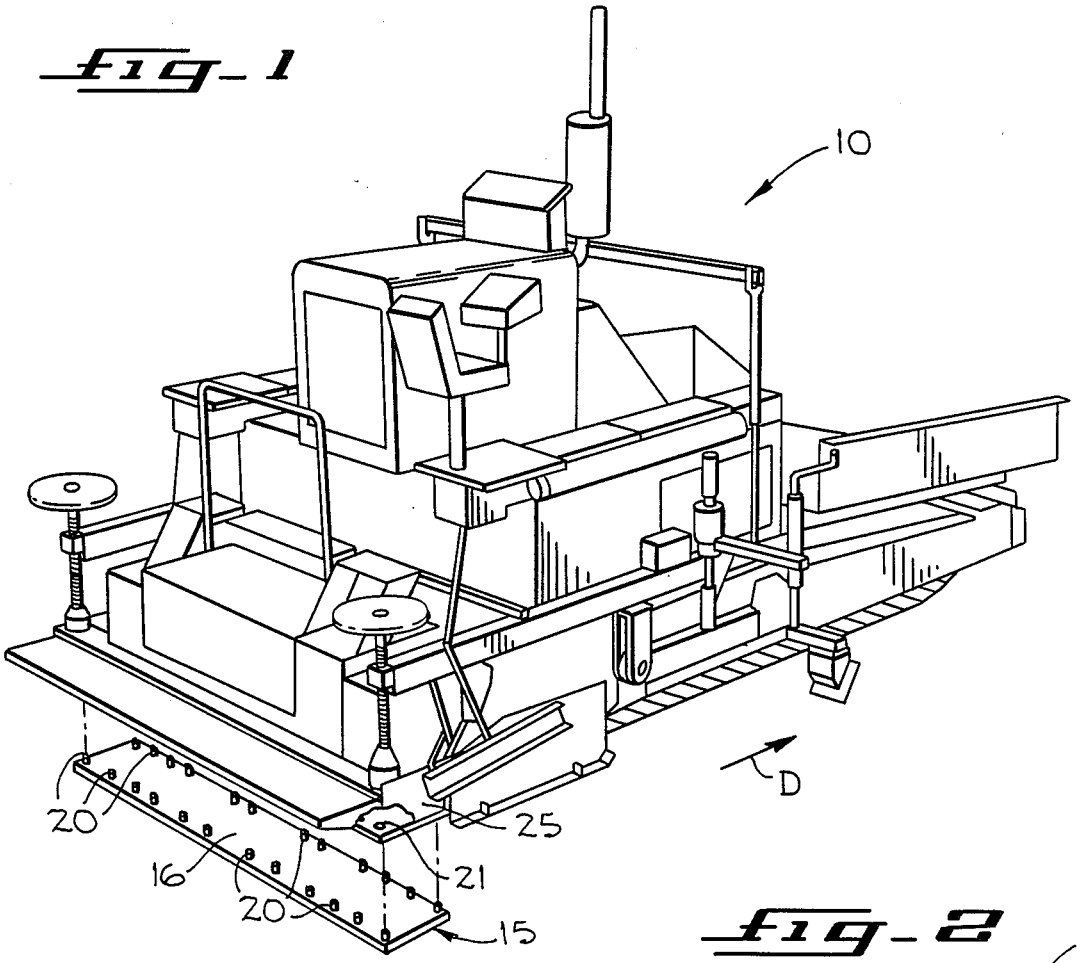
Fig. 2
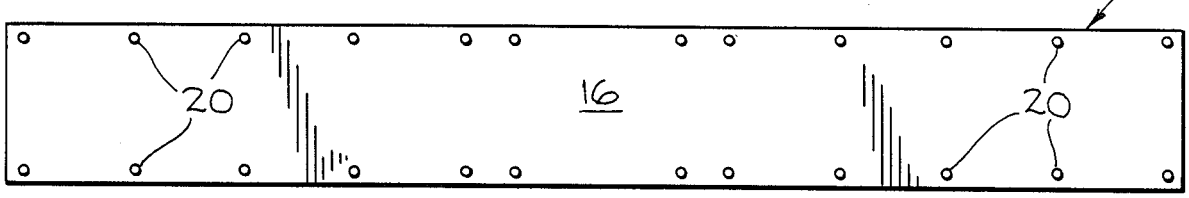
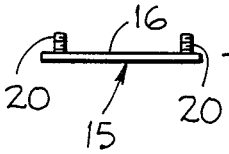
Fig. 3
Fig. 4
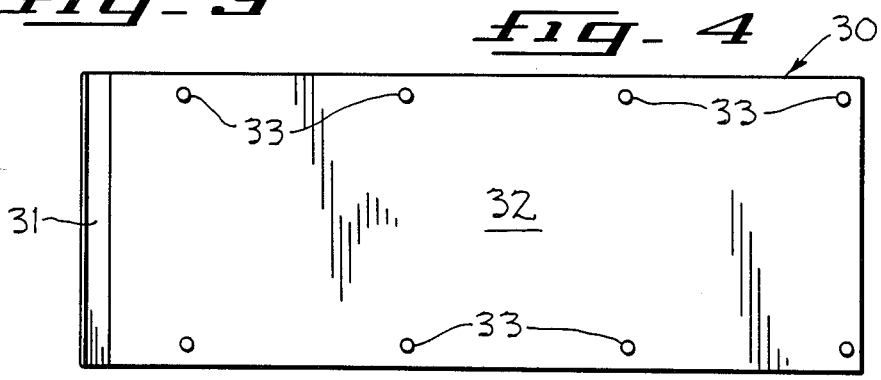
Fig. 5
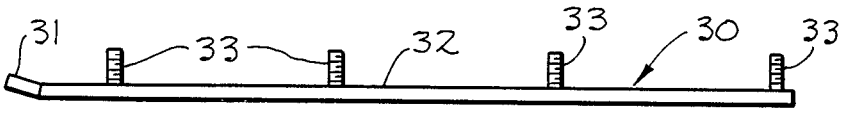

fig_6
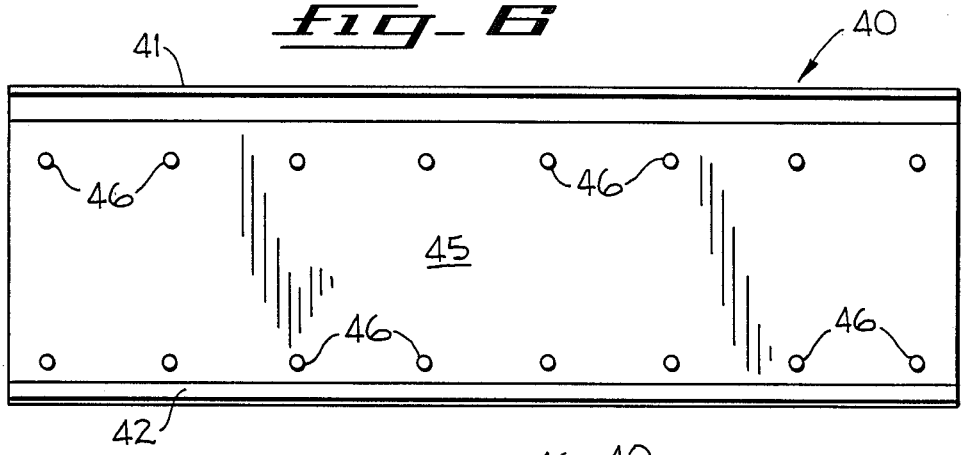
fig_7
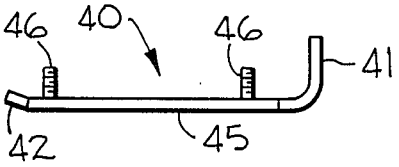
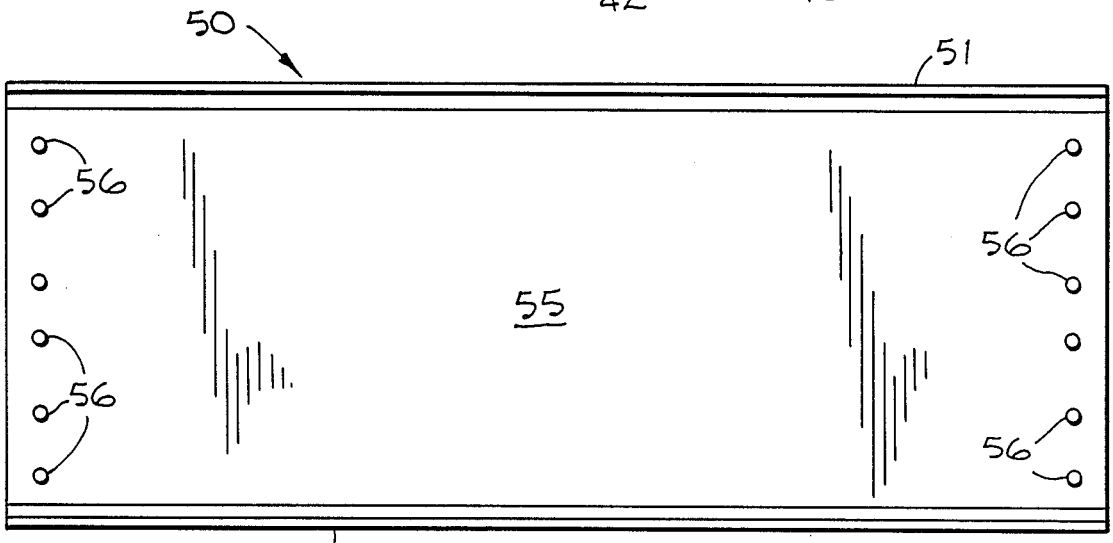
fig_8
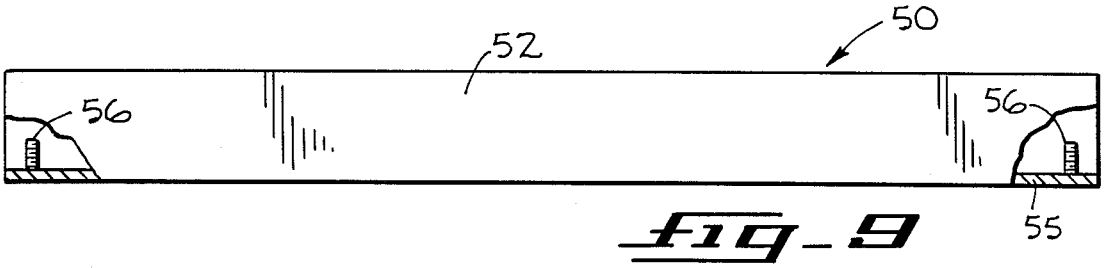
fig_9
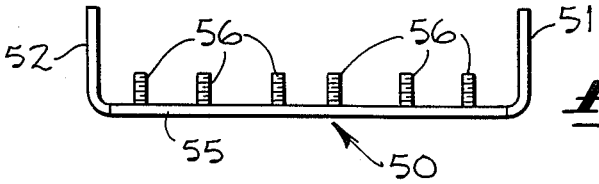
fig_10

SCREED FOR ASPHALT PAVER

BACKGROUND OF THE INVENTION

The present invention relates in general to screeds for asphalt pavers, and more particularly to a screed for an asphalt paver having a high wear resistant bottom plate.

Screeds for asphalt pavers have a tendency to wear out after a relatively short period of use because of the abrasive action of the asphalt. Heretofore, the edges of the screeds engaging the asphalt were made of relatively soft low carbon steel to provide, in certain instances, desired ductability in the construction of the screed. In other instances, the edges of the screeds engaging the asphalt were made of relatively soft steel for the drilling and tapping of the holes to receive the studs used in the attachment of the screed to the asphalt paver. On occasions, low carbon steel studs were used to attach the screed to the asphalt paver. The screed replacements on the asphalt pavers have been relatively frequent because of the abrasive characteristic of the asphalt and the relative softness of the screed edges engaging the asphalt.

In the Barber-Greene Specifications Manual, page 6842, dated 10–67, there is disclosed an asphalt finisher, Model SA-35, in which the screed plate is made of an abrasive resistant alloy steel plate. The screed plate is bolted and doweled to the screed frame, and is replaceable in the field.

The U.S. Pat. to Pollitz, No. 2,914,994, issued on Dec. 1, 1959, for Screed Compensating And Adjusting Means, discloses a screed assembly having a screed plate for contacting the bed of surfacing material. The screed plate is formed of a comparatively thin resilient plate metal.

The Birtchet U.S. Pat. No. 3,673,930, issued on July 4, 1972, for Screed Extension Assembly For Asphalt Paving Machines, discloses a screed extension for the screed of an asphalt paver. The trailing and leading edges of the screed extension are reversible to permit the replacement of a worn edge for extending the life of the screed extension.

SUMMARY OF THE INVENTION

A screed comprising a bottom plate in which the material engaging wall thereof is made of hard steel and in which studs are secured to the material engaging wall of the bottom plate for attachment to a road surfacing vehicle.

A screed comprising a bottom plate in which the material engaging wall thereof is made of steel in the Brinell hardness range of 450–500 to extend the period of time in which the screed may be used.

A screed comprising a curved bottom plate in which the curved sections thereof are made of a low carbon steel and a material engaging bottom wall secured to the curved sections is made of steel in the Brinell hardness range of 450–500 to extend the period of time in which the screed may be used.

A screed comprising a bottom plate in which the material engaging wall thereof is made of steel in the Brinell hardness range of 450–500 to extend the period of time in which the screed may be used and in which stainless steel studs are secured to the material engaging wall of the bottom plate for attachment to a road surfacing vehicle.

A screed comprising a curved bottom plate in which the curved section thereof is made of low carbon steel and a material engaging bottom wall secured to the curved section is made of steel in the Brinell hardness range of 450–500 to extend the period of time in which the screed may be used and in which stainless steel studs are secured to the material engaging wall of the bottom plate for attachment to a road surfacing vehicle.

An object of the present invention is to provide a screed for a road surfacing vehicle that may be used for a relatively long period of time by improving the durability of the surface thereof employed for the levelling of material.

Another object of the present invention is to provide a screed plate for a road surfacing vehicle that can be replaced easily and quickly, and yet may be used for a relatively long period of time by improving the durability of the surface thereof employed for the levelling of material.

BRIEF DESCRIPTION OF THE DRAWINGS

FIG. 1 is a diagrammatic perspective view of an asphalt paver employing a screed plate embodying the present invention.

FIG. 2 is a plan view of the screed plate shown in FIG. 1.

FIG. 3 is an end elevation view of the screed plate shown in FIGS. 1 and 2.

FIG. 4 is a plan view of a screed plate with a curved end edge embodying the present invention adaptable for use with an asphalt paver.

FIG. 5 is a front elevation view of the screed plate shown FIG. 4.

FIG. 6 is a plan view of a screed plate with a curved leading edge and a trailing edge embodying the present invention adaptable for use with an asphalt paver.

FIG. 7 is an end elevation view of the screed plate shown in FIG. 6.

FIG. 8 is a plan view of a screed plate with a curved leading edge and a curved trailing edge embodying the present invention adaptable for use with an asphalt paver.

FIG. 9 is a front elevation view of the screed plate shown in FIG. 8.

FIG. 10 is an end elevation view of the screed plate shown in FIGS. 8 and 9.

DETAILED DESCRIPTION OF THE PREFERRED EMBODIMENTS

Illustrated in FIG. 1 is a conventional and well-known road surfacing machine, such as an asphalt paver 10, on which is mounted a screed assembly 15. The screed assembly 15 is employed for levelling and finishing a bed of surfacing material, such as asphalt.

The screed assembly 15 (FIGS. 2 and 3) comprises a flat screed wear plate 16 embodying the present invention made of steel in the Brinell hardness range of 450–500. The screed wear plate 16 is the bottom plate of the screed assembly 15, which engages the surfacing material during the operation of the asphalt paver 10. Welded to the upper surface of the screed wear plate 16 are threaded stainless studs 20 which are spaced adjacent the longitudinal edges of the screed wear plate 16. The longitudinal edges of the screed wear plate 16 extend transversely to the direction of travel of the asphalt paver 10 as shown by an arrow D of FIG. 1. The studs 20 are received by respective bores 21 in a screed mounting assembly 25 (FIG. 1) of the asphalt paver 10. The bores 21 may be drilled and counterbored, or drilled and tapped holes. Suitable nuts, such as brass nuts, secure the screed wear plate 16 to the screed mounting assembly 25 by threaded engagement with the stainless steel studs 20.

The screed assembly 15 other than the flat screed wear plate 16 and the stainless steel studs 20 and the screed mounting assembly 25 are well-known in the art and may vary between various models of a manufacturer and may vary from manufacturer to manufacturer. The screed assembly 15 other than the flat screed wear plate 16 and the stainless steel studs 20, and the screed mounting assembly 25 are, therefore, shown diagramatically.

Illustrated in FIGS. 4 and 5 is a screed assembly 30 which is adapted to be mounted on a conventional and well-known asphalt paver, such as the asphalt paver 10 shown in FIG. 1. The asphalt paver on which the screed assembly 30 is mounted has a screed mounting assembly similar to the screed mounting assembly 25 of FIG. 1 but with a curved end edge.

In the original screed assembly for the asphalt paver, a low carbon steel end edge 31 was attached to the curved leading edge of the screed mounting assembly through bolts or threaded carbon steel studs. A flat screed wear plate of soft steel of the original screed assembly was drilled and tapped for mounting bolts or carbon steel threaded studs to secure the flat screed wear plate to the screed mounting assembly. Soft steel or low carbon steel was used because of its ductability that lends itself for the drilling and tapping of holes to receive the studs or bolts.

The screed assembly 30 of the present invention includes a flat screed wear plate 32 embodying the present invention of steel in the Brinell range of 450–500 to replace the flat screed wear plate made of soft steel. The flat screed wear plate 32 is the bottom plate of the screed assembly 30 and engages the surfacing material of a road or the like during the operation of the asphalt paver. The end edge 31 of the screed assembly 30 has the flat screed wear plate 32 welded thereto. Welded to the upper surface of the screed wear plate 32 are threaded stainless studs 33, which are spaced adjacent the longitudinal edges of the screed wear plate 32. The studs 33 are received by respective bores, such as bores 21, in the screed mounting assembly of the asphalt paver. The bores may be drilled and counterbored, or drilled and tapped holes. Suitable nuts, such as brass nuts, secure the screed wear plate 32 to the screed mounting assembly by threaded engagement with the stainless steel studs 33.

Illustrated in FIGS. 6 and 7 is a screed assembly 40 which is adapted to be mounted on a conventional and well-known asphalt paver, such as the asphalt paver 10 shown in FIG. 1. The asphalt paver on which the screed assembly 30 is mounted has a screed mounting assembly similar to the screed mounting assembly 25 of FIG. 1 but with a curved leading edge and a trailing edge.

In the original screed assembly for the asphalt paver, a low carbon steel curved leading edge 41 was attached to the curved leading edge of the screed mounting assembly through bolts or threaded carbon steel studs. A low carbon steel trailing edge 42 of the original screed was attached to the trailing edge of the screed mounting assembly through bolts or threaded carbon steel studs. A flat screed wear plate of soft steel of the original screed was drilled and tapped for mounting bolts or carbon steel threaded studs to secure the flat screed wear plate to the screed mounting assembly of the original screed. Soft steel or low carbon steel was used because of its ductibility that lends itself to the drilling and tapping of holes to the threaded studs or bolts.

The screed assembly 40 of the present invention includes a flat screed wear plate 45 embodying the present invention of steel in the Brinell range of 450–500 to replace the flat screed wear plate made of soft or low carbon steel. The flat screed wear plate 45 is the bottom plate of the screed assembly 40 and engages the surfacing material of a road or the like during the operation of the asphalt paver. The flat screed wear plate 45 is welded to the leading edge 41 and the trailing edge 42. Welded to the upper surface of the screed wear plate 45 are threaded stainless steel studs 46, which are spaced adjacent the longitudinal edges of the screed wear plate 45. The studs 46 are received by respective bores, similar to the bores 21, in the screed mounting assembly of the asphalt paver. The bores may be drilled and counterbored, or drilled and tapped holes. Suitable nuts, such as brass nuts, secure the screed wear plate 45 to the screed mounting assembly by threaded engagement with the stainless steel studs 46.

Illustrated in FIGS. 8–10 is a screed mounting assembly 50 which is adapted to be mounted on a conventional and well-known asphalt paver, such as the asphalt paver 10 shown in FIG. 1. The asphalt paver on which the screed assembly 50 is mounted has a screed mounting assembly similar to the screed mounting assembly 25 of FIG. 1 but with a curved leading edge and a curved trailing edge.

In the original screed assembly for the asphalt paver, a low carbon steel curved leading edge 51 was attached to the curved leading edge of the screed mounting assembly through bolts or threaded carbon steel studs. A low carbon steel trailing edge 52 of the original screed assembly was attached to the trailing edge of the screed mounting assembly through bolts or threaded carbon steel studs. A flat screed wear plate of soft steel of the original screed assembly was drilled and tapped for mounting bolts or carbon steel threaded studs to secure the flat screed wear plate to the screed mounting assembly Soft steel or low carbon steel was used because of its ductibility that lends itself for the drilling and tapping of holes to the threaded studs or bolts.

The screed assembly 50 includes a flat screed wear plate 55 embodying the present invention of steel in the Brinell range of 450–500 to replace the flat screed wear plate made of soft or low carbon steel. The flat screed wear plate 55 is the bottom plate of the screed assembly 50 and engages the surfacing material of a road or the like during the operation of the asphalt paver. The flat screed wear plate 55 is welded to the leading edge 51 and the trailing edge 52. Welded to the upper surface of the screed wear plate 55 are threaded stainless steel studs 56, which are spaced adjacent the longitudinal edges of the screed wear plate 55. The studs 56 are received by respective bores, similar to the bores 21, in the screed mounting assembly of the asphalt paver. The bores may be drilled and counterbored, or drilled and tapped holes. Suitable nuts, such as brass nuts, secure the screed wear plate 55 to the screed mounting assembly by threaded engagement with the stainless steel studs 56.

Reference herein is made to longitudinal edges of a wear plate. The longitudinal edges of the wear plate extend transversely to the direction of travel of the road surfacing machine.

What is claimed is:

1. A screed for a road surfacing machine comprising:

(a) a flat bottom plate of hard steel for engaging road surface material, said bottom plate having an upper surface, said flat bottom plate being made of steel in the Brinell range of 450–500; and (b) threaded studs secured to the upper surface of said flat bottom plate for attachment to the road surfacing machine.

2. A screed as claimed in claim 1 wherein said studs are made of stainless steel.

3. A screed as claimed in claim 1 wherein said flat bottom plate includes a leading edge and said screed includes another leading edge confronting the leading edge of said flat bottom plate, and said leading edge of said flat bottom plate is secured to said other leading edge of said screed.

4. A screed as claimed in claim 2 wherein said flat bottom plate includes a leading edge and said screed includes another leading edge confronting the leading edge of said flat bottom plate, said other leading edge being curved, and said leading edge of said flat bottom plate is secured to said curved other leading edge of said screed.

5. A screed as claimed in claim 3 wherein said flat bottom plate includes a trailing edge and said screed includes another trailing edge confronting the trailing edge of said flat bottom plate, and said trailing edge of said flat bottom plate is secured to said other trailing edge of said screed.

6. A screed as claimed in claim 4 wherein said flat bottom plate includes a trailing edge and said screed includes another trailing edge confronting the trailing edge of said flat bottom plate, said other trailing edge being curved, and said trailing edge of said flat bottom plate is secured to said curved other trailing edge of said screed.

7. A screed as claimed in claim 3 wherein said other leading edge of said screed is made of ductible steel.

8. A screed as claimed in claim 4 wherein said curved other leading edge of said screed is made of ductible steel.

9. A screed as claimed in claim 5 wherein said other trailing edge of said screed is made of ductible steel.

10. A screed as claimed in claim 6 wherein said other trailing edge of said screed is made of ductible steel.

* * * * *